US006874163B2

(12) United States Patent
Marshall

(10) Patent No.: US 6,874,163 B2
(45) Date of Patent: Apr. 5, 2005

(54) LOAD CARRYING ASSEMBLY

(76) Inventor: Peter Alan Marshall, 41 McKellar Street, Braidwood, New South Wales 2622 (AU)

( * ) Notice: Subject to any disclaimer, the term of this patent is extended or adjusted under 35 U.S.C. 154(b) by 115 days.

(21) Appl. No.: 10/275,184

(22) PCT Filed: Jun. 4, 2001

(86) PCT No.: PCT/AU01/00657

§ 371 (c)(1),
(2), (4) Date: Nov. 1, 2002

(87) PCT Pub. No.: WO01/93710

PCT Pub. Date: Dec. 13, 2001

(65) Prior Publication Data

US 2003/0101508 A1 Jun. 5, 2003

(30) Foreign Application Priority Data

Jun. 6, 2000 (AU) ..... PQ 7988

(51) Int. Cl.[7] ..... A41D 1/04; A41D 27/20
(52) U.S. Cl. ..... 2/102; 2/251
(58) Field of Search ..... 2/102, 94, 247, 2/101, 251, 253; 224/901, 603, 646, 182, 223, 660, 901.8

(56) References Cited

U.S. PATENT DOCUMENTS

| | | | | | |
|---|---|---|---|---|---|
| 274,092 | A | * | 3/1883 | Geary | 2/251 |
| 902,084 | A | * | 10/1908 | Hylten-Cavallus | 2/102 |
| 2,409,354 | A | * | 10/1946 | Grunwell | 128/202.19 |
| 3,440,666 | A | * | 4/1969 | Fitzpatrick | 2/251 |
| 4,235,356 | A | * | 11/1980 | Atchisson | 224/192 |
| 4,555,812 | A | * | 12/1985 | Akers | 2/94 |
| 4,796,304 | A | * | 1/1989 | Shelby | 2/94 |
| 5,007,427 | A | * | 4/1991 | Suzuki et al. | 600/436 |
| 5,031,244 | A | * | 7/1991 | Inagaki | 2/102 |
| 5,072,458 | A | * | 12/1991 | Suzuki | 2/102 |
| 5,073,984 | A | * | 12/1991 | Tone et al. | 2/457 |
| 5,265,782 | A | * | 11/1993 | McNamara | 2/94 |
| 5,617,582 | A | * | 4/1997 | Burwell | 2/102 |
| 5,617,587 | A | * | 4/1997 | Marchbanks | 2/247 |
| 6,035,453 | A | * | 3/2000 | Cain | 2/462 |
| 6,185,738 | B1 | * | 2/2001 | Sidebottom | 2/2.5 |

FOREIGN PATENT DOCUMENTS

JP 2002088546 A * 3/2002 ..... A41D/27/20

* cited by examiner

*Primary Examiner*—Rodney M. Lindsey

(57) ABSTRACT

A load-carrying assembly (10) [FIG. 2] is disclosed comprising a panel (14) having a grid of holes (54) formed therein and at least one load-carrying pouch (26) attached to the panel by means of stud-like fasteners (40, 41) that pass through the holes (54) and through perforations (56, 72) formed in the pouch (26). The panel (14) is preferably formed from a woven textile mesh in which the total area of the holes is less than 75% of the area of the panel, in which the mesh is less extensible in the vertical (load-carrying) direction than in the lateral or horizontal direction, and in which the studs are preferably a close fit in the holes of the mesh and the perforations of the pouch.

3 Claims, 2 Drawing Sheets

LOAD CARRYING ASSEMBLY

TECHNICAL FIELD

This invention relates to load carrying assemblies suitable for use in supporting loads from garments, packs or the like. It also relates to load-supporting garments, saddles, packs and the like or to portions thereof.

The load carrying assemblies and the garments or packs of the invention will be of use to armed service personnel, sports persons, medical and veterinarian field officers, fishermen, hikers, tradesmen and many others who need to carry small items of equipment in a manner convenient to access. The load carrying assemblies may also be in the form of saddles other coverings used with animals, motorbikes and other machines. They may be in the form of kits for tools, first aid or emergency equipment or the like not designed to be worn or supported by people, animals or machines. Generally, the load items will be carried in or by pouches, pockets, suspension loops, holsters, specially formed sockets or the like containers or supports, which are secured to the garment, pack or kit. In this specification the term 'pouch' will be used to encompass all such holder, container or support means. The term 'pouch' thus encompasses flexible or rigid suspension loops bottomless holsters and the like made of leather, plastics, metal, textile or sheet material; as well as textile or sheet-form pockets, bags and the like.

BACKGROUND TO THE INVENTION

It is well known to employ detachable load carrying pouches on backpacks and garments such as vests and trousers so that the user may select and attach pouches that are appropriate to his or her immediate needs. It is perhaps most common to attach the pouches by the use of clips, snap-fasteners, buckles, ties or loops, which are sewn or otherwise secured to the material of the garment. One of many examples is U.S. Pat. No. 4,106,121 to Belson, which discloses the use of metal snap-fasteners to secure pouches to a garment. Such methods of attachment are not very satisfactory because there are generally only a few pre-attached fasteners, restricting the size and location of pouch attachment. Also, if a heavy load is carried in a pouch, the strain on the few fasteners supporting that pouch will be great so that they may break, come apart or tear out. In any event, the resultant distortion of the garment is likely to be most uncomfortable.

It is known to spread the load of a pouch by the use of hook-and-loop materials such as Velcro™; for example, U.S. Pat. No. 5,991,925 to Wu, 5,644,792 to Tishler et al, 5,465,425 to Chrispin, 5,014,359 to Hanson, 4,382,302 to Watson, 4,241,459 to Quayle and 4,106,121 to Belson. It is also known to spread the load of a detachable pouch by the use of zips, as in U.S. Pat. No. 5,809,802 to Puco and 4,369,526 to Clutts. The pouches may be attached individually (as in most of the above mentioned cases) or in groups affixed to panels, as in the case of Clults. These references demonstrate a wide variety of intended applications and uses, which represent most of the fields of use or application listed above.

The use of fastener systems that require part of a fastener to be permanently secured to or built into a garment or pack for the attachment of load-carrying pouches lacks flexibility because the location and positioning of the fasteners is predetermined or fixed. Also, it is generally essential that matching fastener portions be incorporated at appropriate locations in the pouches. This means that the pouches must be tailored to suit the nature and location of the fasteners on the carrier, irrespective of pouch size and shape, even where attempts are made to ensure that the 'footprints' of the pouches are modular in some respect. As a result, pouches intended for on one garment by one manufacturer often cannot be fitted to another garment or to the garment of another manufacturer. Thus, a load-carrying vest having detachable pouches intended for use by a fisherman will not be able to carry the specialised detachable pouches needed by a paramedic or a soldier. A vest having detachable pouches suitable for carrying the tools of a cabinetmaker is not likely to be useful for a framing carpenter. Exercise vests for persons of different size and gender may not be able to employ common weight pouches. The location of fasteners on one exercise vest may be suited to support a given pouch carrying a light or evenly distributed weight but be quite unsuited to the support of the same pouch carrying-a heavier or unevenly distributed weight.

However, in some cases—as in Crispin and Wu mentioned above—such large areas of the vest are covered with the loop half of a Velcro™ fastener that pouches of a variety of types and shapes can be mounted in place at a variety of angles and locations. Not only is it expensive to cover a garment with Velcro™ material but the breathing and thermal properties of the garment will be greatly affected. Moreover, when the garment is worn in the field, the exposed areas of the Velcro™-material become so clogged with vegetable matter and soil that the position of existing pouches cannot be easily changed and new pouches cannot be securely attached, so the flexibility of the garment is lost.

It is well known to employ netting or mesh materials for garments, or portions thereof, usually for lightness and ventilation; see for example, U.S. Pat. No. 5,913,409 to Test and U.S. Pat. No. 3,885,248 to Salsby. Mesh materials are also employed for pockets, especially for fishermen and hunters. Test discloses the use of a vest having mesh panels and mesh and normal fabric pockets attached thereto. However, the manner of attachment is not disclosed and is problematical.

OUTLINE OF THE INVENTION

From one aspect, the present invention involves the use of a thin flexible panel having a grid of holes therein, a pouch having perforations, and stud-like fastener means for securing the pouch to the panel by passing through appropriate ones of the holes and perforations. The panel is preferably a textile mesh that is preferably woven or knitted from continuous filament fiber, preferably in such a way that it is relatively inextensible in the vertical direction but relatively extensible in the horizontal direction. Such a panel may be affixed to the front or rear surface of clothing, carry packs, saddles or kits, or may itself serve as the piece of clothing (e.g., a vest), the pack, saddle or the basic element of a kit. When the panel is attached to a piece of clothing, a saddle or pack, it will be normal to secure it to the outside thereof so that the attached pouches are on the outside. However, there may be occasions where it is desirable to attach pouches to the inside surface of a piece of clothing, pack, etc.

For convenience, the panels, attached pouches and associated stud-like fastener means will be referred to generically as 'load carrying assemblies' and it will be said that the pouches are attached to the front of the panel, while the stud-like fasteners are inserted from the rear or back of the panel. Thus, unless otherwise made clear, the terms 'front' and 'rear' or 'back' do not refer to the front and back of a person that might be wearing or supporting a load carrying assembly.

As indicated, the panel may be formed from strong textile mesh made of woven or knitted continuous filament synthetic plastics material such as polyester, polypropylene, nylon, Kevlar or the like. Such materials can be thin, highly flexible and feel soft, yet be very strong and able to resist pull-through of stud-like fasteners. They can be made to have anisotropic physical characteristics so as to be less extensible in one direction than the other, a feature that is well adapted to load carrying garments where vertical inextensibility is desirable for load carrying but lateral extensibility is desirable for comfort. Such woven mesh materials also have the advantage, when used with saddles or clothing, that they permit the free flow of moisture and air there-through. Furthermore, such materials have the advantage of shedding rather than accumulating dirt and vegetable matter. Alternatively, but less preferably, the panel material may be plastic sheeting or closely woven textile material that is perforated all over with a grid of holes. The latter materials are likely to be less comfortable to wear, cost more because of the need for the perforation step and may be prone to tearing or fraying. They are therefore less preferable than the woven or knitted textile mesh materials.

The pouches may have a back face, peripheral flange or tabs having perforations or holes formed therein, which are adapted to engage the stud-like fastener means and to thereby support the pouches from the panel. Desirably, the average spacing of the holes of the mesh will be much smaller that the spacing between adjacent perforations in the pouch material, so the pouches can be positioned at any desired or appropriate location without regard to the mesh module. Preferably, the spacing of the perforations in the pouch is at least three times that of the spacing of the holes in the panel. With closely spaced panel holes, the perforations of the pouch can be arranged anywhere to suit the shape of the pouch and the load it is required to carry, without regard to the location of the holes in the panel mesh. The perforations may be affixed in a row along the top of the pouch, around its periphery or spotted anywhere over the back of the pouch. Desirably, the material of the pouch that is perforated to take the stud like fastener means should be in-extensible and fit tightly onto the studs so as to prevent the fastener means from being pulled back there-through, thereby releasing the pouch from the panel.

Conveniently, the fastener means simply comprise a plurality of studs, each having a relatively large flanged foot, a relatively thin neck or shank portion. In one form, each stud is formed with an enlarged pointed head on the end of the shank remote from the foot. The head is adapted to be forced through a hole of the panel without damage to the material, while the flanged base is adapted to ensure that the stud cannot be pulled right through the panel. The head is preferably pointed and barbed so that it can be pushed through a tight-fitting hole in the pouch material and be most difficult to pull back through the hole. If desired, the heads of the studs can be split or slit to allow them to be compressed when entering the holes of the mesh or the perforations of the pouch. If desired, a push on cap or retainer can be pressed onto or over the head to cover the pointed head and/or to ensure that the shank of the stud cannot pull rearward through the perforation of the pouch.

In another form, the shank of a stud may not have an enlarged head but be adapted to take a tight-fitting push-on cap or retainer that is difficult to remove when once forced onto the shank. For this purpose, the shank may be formed with a plurality of peripheral grooves—perhaps formed with a barb or wedge like shape—that allow a ring-like retainer to be pushed rearward on the shank to clamp the material of the pouch to the front face of the panel. The studs can be conveniently formed by upsetting from metal rod or by injection molding from inexpensive plastics material. The use of plastics material is preferred because it is cheap, will not corrode and can be easily cut using clippers or the like to remove a pouch from the panel, when desired.

As already indicated, it is desirable that the shank of the stud-like fastener be a close fit in the holes of the panel and the perforations of the pouches, and it is also desirable that the proportion of the area of the panel accounted for by the holes is much smaller than it would be for a normal net-like mesh. For example, the area of the holes is desirably less than 75% of the area of the panel, preferably between 25% and 60%, and most preferably between 33% and 50% of the area of the panel.

An entire garment such as a vest, shirt or jacket may be formed from the mesh panel and large capacity pouches can be attached on the back and front of the vest to carry large loads. Such a panel or mesh vest can be worn over or sewn to a normal vest, shirt or jacket for warmth or comfort. It may incorporate braces, hip-belts and the like weight distribution means. However, it may more usual to attach mesh panels to normal garments, uniforms or packs to support smaller pouches at locations where they will be readily accessible by the wearer, such as on the front of the chest and stomach area and on the fronts and sides of the thighs. Where a mesh panel is sewn to a lining or a garment or pack, it is desirable to ensure hand-access to the back of the panel to permit insertion of the fastener studs. This can be effected by leaving one side (normally the bottom edge) of the mesh panel unattached to the base garment or lining, by detachably affixing one or more sides of the panel to the garment or lining by a zip or Velcro™ type closure, or by forming an access slit in the garment or lining that, again, may be closable using a zip or Velcro™.

As already indicated, each pouch may be provided with a peripheral flange-like edging of tough rip-resistant material having appropriately placed peforations (holes or slits) for receiving the heads of the fixing studs. Alternatively, a pocket-like pouch might have a flap attached to its upper back portion with the attachment slits or holes so that, after attachment, the heads of the studs will be behind the pouch and the pouch will hang down from the flap. Alternatively, or additionally, the back of the pouch itself may have holes or slits to accommodate the heads of the studs. This may be of particular value where a hammer, drill or other heavy tool, or a pistol, needs to be supported in a holster-like pouch having a relatively thick or rigid back plate needed to hold the top of the pouch open.

DESCRIPTION OF EXAMPLES

Having portrayed the nature of the present invention, a particular example will now be described with reference to the accompanying drawings. However, those skilled in the art will appreciate that many variations and modifications can be made to the example without departing from the scope of the invention as outlined above. In the accompanying drawings.

Figure 1:
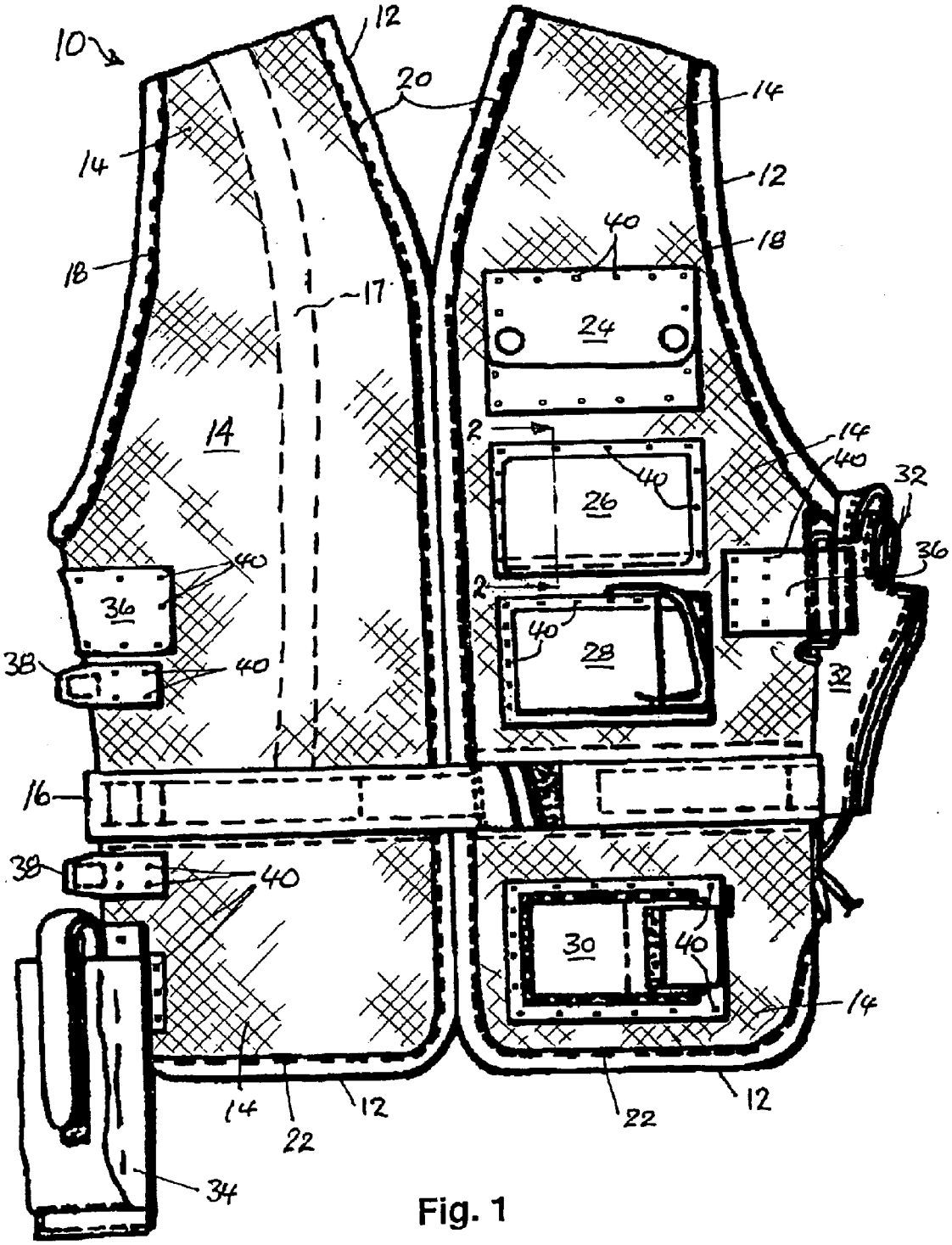
FIG. 1 is a front elevation of a vest-like garment having load-carrying pouches attached thereto.
Figure 2A:
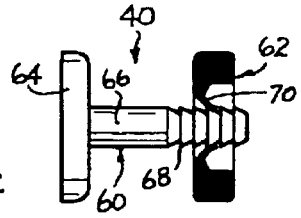
FIG. 2 is a sectional end elevation of the vest and portion of a pouch taken on section line 2—2 of FIG. 1, FIG. 2A being an enlarged view of a stud fastener.
Figure 4:
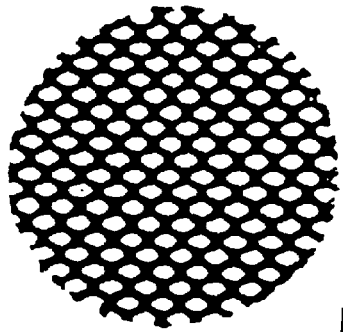
FIGS. 3 to 6 are representations of various forms of woven mesh suitable for use with the panels and pouches of the vest of FIG. 1.
Figure 2:
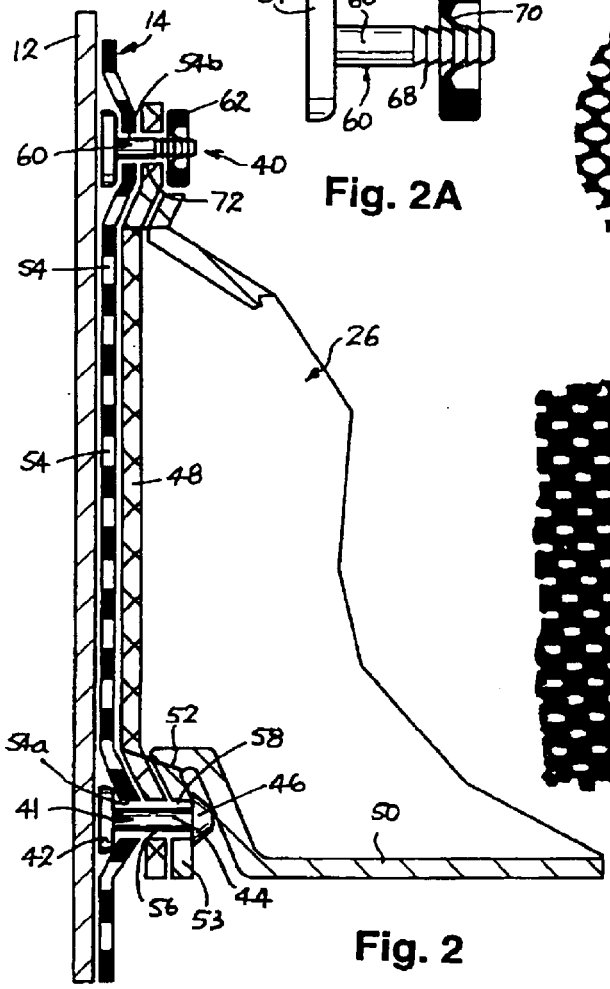
Figure 5:
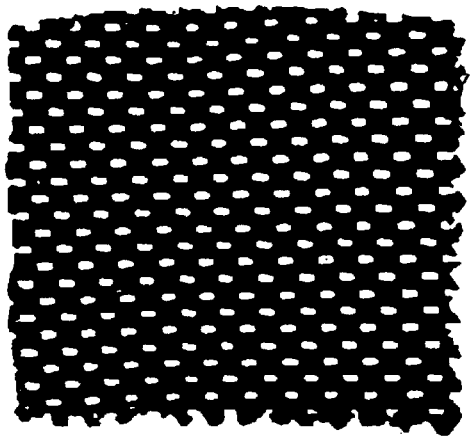
Figure 3:
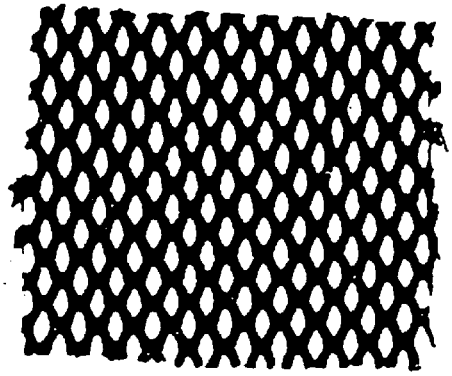
Figure 6:
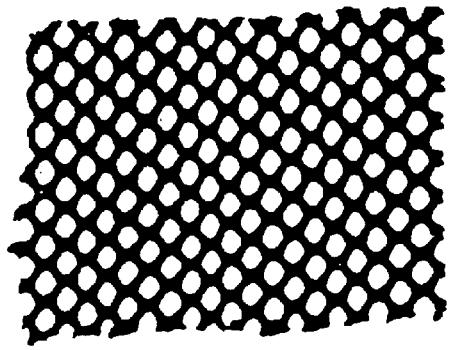

With reference to FIGS. 1 and 2, the chosen example of the application of the principles of the present invention is a vest 10 suitable for use by military or paramilitary personnel, or by hunters and fishermen, or by tradesmen and service men. It comprises a conventionally formed under-vest 12 made from any known comfortable textile material in the normal way that a vest would be made for any one of the users indicated. An over-vest 14 of an open-weave textile mesh material, having a similar cut, to under-vest 12, is hung over under-vest 12. In this example, the mesh over-vest 14 forms the panel mentioned above and is woven from continuous filament nylon yarn so that the total area of the holes in the mesh constitute about 50% of the total area of the panel or over-vest 14. The material of panel 14 is woven—in a manner known in the art—so that it is relatively inextensible in the vertical direction and relatively extensible in the horizontal direction.

Over-vest or panel 14 can be simply laid over under-vest 12, which may comprise a normal article of clothing such as a vest shirt or jacket. To distribute the load of the panel 14 and to secure it in place on the wearer, over-vest or panel 14 is fitted with a belt 16 and, optionally, with braces 17 (shown in broken lines on one side of panel 14 only for clarity of illustration). Over-vest or panel 14 may be sewn to under-vest 12 around the arm holes and front opening by stitching seams as indicated at 18 and 20, the bottom edge 22 of panel 14 being left unattached or detachably secured by a zipper (not shown). If desired, the entire front mesh-vest or panel 14 can be attached to rear vest 12 by zippers (not shown).

In this example, four rectangular pockets 24 to 30 are shown attached to the left hand side (from the wearer's viewpoint) of vest 10, together with a holster 32. As illustrated, only a tool or ammunition pouch 34 is shown attached to the right side of vest 10, it being assumed that other pouches will be attached to the right hand side in order to balance the weight carried by the vest. Holster 32 is shown suspended from a back-strap 36 that is secured to panel 14 and a pair of tags 38 are shown on the right side for attachment of specialised equipment or pouches.

In each case, pouches 24–30 and 34, back strap 36 and tags 38 are attached to over-vest 14 by the use of studs 40. FIG. 2 is a section taken through pouch 26 on section line 2—2 in FIG. 1. Section line 2—2 passes through an upper stud 40 and a lower stud 41 (not visible in FIG. 1) It will be seen that stud 41 is similar in shape to a stud for a dress shirt, having a wide base flange or foot 42, a relatively narrow shank 44 and an enlarged pointed or rounded head 46. In this example, the back element 48 of pouch 26 is sewn to the bottom element 50 of the pouch by a seam indicated at 52 to form a lower peripheral flap or hem, generally indicated at 53. However, the elements 48 and 50 can be bonded by heat or adhesive instead of being sewn in order to form hem 53. As shown in FIG. 2, over-vest or panel 14 has a grid of holes 54. Stud 41 passes through an appropriately located hole 54*a* in the mesh of panel 14 to engage and pass through pre-formed perforations, 56 and 58, in back element 48 and bottom element 50 of pouch 26, respectively. The material of bottom element 50 is such that, once head 46 of stud 40 has been pushed through perforation 58, it will be difficult or impossible to remove without extending or damaging perforation 58.

The preferred stud-like fastener means 40 is shown at the top of pouch 26 and in the enlarged detail of FIG. 2A. It consists of two parts, a stud 60 and a keeper 62. Stud 60 has a foot 64 and a headless shank 66 that has a series of barbs or grooves 68 formed thereon. Keeper 62 is ring-like and has an integral diaphragm-like catch 70, which engages grooves or barbs 68 like a pawl when the keeper is pressed onto shank 66 of stud 60. Stud 60 is shown inserted through a hole 54*b* of panel 14 from the back of the panel, stud 60 passing through a perforation 72 in the upper periphery of the back element 48 of pouch 26.

For the purposes of illustration, holes 54, 54*a* and 54*b* in panel 14 have been shown larger than the shanks 44 and 62 of studs 41 and 40. However, it is desirable—as already indicated—for the shanks of the studs to be a good tight fit in the holes of the mesh of the panel. Indeed, it is preferable that the shanks be a little larger in area than a hole so that the mesh is distorted and stretched somewhat to accommodate the shank. This will reduce the danger of stud pull-out and will reduce wear of the panel due to movement between the stud and the hole in the panel.

FIGS. 3 to 6 illustrate commercially available meshes suitable for use as the panel or over-vest 14 of FIG. 1. As previously indicated, these fabrics can be woven from a variety of synthetic filaments and are sufficiently strong and resistant to stretching to prevent the base flanges 42 and 62 of studs 41 and 40 being pulled through holes 54*a* and 54*b*, respectively.

Though one example and some variants of that example have been described, it will be appreciated that many other examples and variations or additions are possible without departing from the scope of the invention as defined by the following claims.

What is claimed is:

1. A garment incorporating a load-carrying assembly wherein:

the load-carrying assembly comprises a thin flexible panel of textile fabric mesh having at least one load-carrying pouch attached thereto by a plurality of studs, each of said studs has an elongate shank having an rear end and a front end, said rear end having a flat laterally extending foot, said panel defines a grid of holes that extends both vertically and horizontally over an area of said panel when the garment is worn by a standing person, said panel has a rear face arranged adjacent to the garment and an opposing front face, said pouch has a rear surface arranged against said front face of the panel, said rear surface of said pouch has a plurality of perforations formed therein, said panel is attached to the garment so that a person's hand can be inserted between said rear face of the panel and the garment to effect the insertion of said front end of each of said studs first through a respective hole in the panel from the rear face thereof and then through a respective perforation in the pouch from the rear surface thereof so as to attach the pouch to the front face of the panel, the shank of each stud is a close-fit in both the respective hole in the panel and in the respective perforation of the pouch, and wherein said area of the panel is substantially greater than said rear surface of the pouch so that the pouch can be attached to the panel in various positions and orientations on the panel using said holes and said studs.

2. A garment incorporating a load carrying assembly according to claim 1, wherein:

said panel comprises a textile fabric mesh having substantially greater horizontal extensibility than vertical extensibility.

3. A garment incorporating a load carrying assembly according to claim 1 or 2, wherein:

the panel is a woven textile mesh, each of said holes has an area such that the combined area of the holes in the panel is between 25% and 60% of said area of the panel, each hole is greater than 1 mm and less than 5 mm in largest dimension and, the shank of each of said studs has a cross-sectional area at least equal to the area of each hole.

* * * * *